US005416635A

United States Patent [19]

Christianson et al.

[11] Patent Number: 5,416,635

[45] Date of Patent: May 16, 1995

[54] PORTABLE CONDENSATION-FREE SHOWER MIRROR

[75] Inventors: Thomas R. Christianson; Jeanne L. Christianson, both of Napa, Calif.

[73] Assignee: ShowerTek, Inc., Napa, Calif.

[21] Appl. No.: 136,682

[22] Filed: Oct. 14, 1993

[51] Int. Cl.[6] ..... G02B 5/08; A45D 42/14

[52] U.S. Cl. ..... 359/509; 359/512; 359/845; 4/605; 248/467; 383/901

[58] Field of Search ..... 4/597, 605; 132/291; 248/466, 467; 359/507, 509, 512, 514, 840, 845, 513, 846, 847; 383/901; 15/250.003

[56] References Cited

U.S. PATENT DOCUMENTS

| | | | |
|---|---|---|---|
| 4,024,429 | 12/1935 | Casey | 383/901 |
| 4,024,430 | 12/1935 | Casey | 383/901 |
| 4,327,961 | 5/1982 | Kladitis | 359/512 |
| 4,655,559 | 4/1987 | Odell | 359/512 |
| 4,832,475 | 5/1989 | Daniels | 359/512 |
| 4,889,141 | 12/1989 | Lindsey | 132/291 |
| 4,904,072 | 2/1990 | Christianson | 359/512 |
| 5,313,316 | 5/1994 | Davidge | 359/845 |

*Primary Examiner*—Loha Ben
*Assistant Examiner*—John Juba, Jr.
*Attorney, Agent, or Firm*—David Pressman

[57] ABSTRACT

A condensation-free shower mirror includes a housing (11) holding a mirror (10) and a urethane water container (18). The water container, which is substantially the same size and shape as the mirror, is fitted against the back side of the mirror. The water container is fitted with a filling-cap assembly (12) to allow a water-tight seal. Two suction cups (14) extending from the back side of the housing allows the shower mirror to be easily mounted against a shower stall or a wall mirror. When the container is filled with hot water, it heats the mirror above the dew point of water, so that the mirror will remain condensation-free in a steamy environment. Because the shower mirror can be filled with hot tap water, it is portable so that it can be conveniently used in any bathroom.

18 Claims, 2 Drawing Sheets

PORTABLE CONDENSATION-FREE SHOWER MIRROR

BACKGROUND

1. Field of Invention

This invention relates generally to mirrors, specifically to a portable, condensation-free mirror for use in a bathroom, shower, or other steamy environment.

2. Prior Art

Many men prefer to shave while showering or bathing, because a closer shave can be achieved when the beard is softened by the steam and hot water, and the shaving cream and shavings can be conveniently rinsed away. Many women like to apply skin treatments immediately after a hot shower while their skin is still moist and soft. Such grooming cannot be done in front of a conventional mirror, because in a steamy bathroom, a thick layer of condensation will form on the cold mirror to completely obscure it.

Condensation-free mirrors have been designed to allow grooming in steamy bathrooms. U.S. Pat. No. 4,904,072 to Christianson (1990) shows a mirror for mounting on the pipe of a shower head. Hot water bled from the pipe heats the mirror above the dew point of water, preventing condensation on the mirror and keeping it clear. However, it cannot be conveniently moved from one shower to another, as a traveler might desire when staying in hotels not equipped with such a mirror. U.S. Pat. No. 4,327,961 to Kladitis (1982) shows a portable mirror with a water chamber behind it. The chamber can be filled with hot water to keep the mirror condensation-free. However, the mirror is used to define part of the chamber, so that a water-tight and heat resistant seal must be achieved at the interface between the mirror and the rest of the chamber. Such a seal will be very fragile, because glue must be applied to the reflective coating on the back side of the mirror, which can easily delaminate from the glass or plastic surface of the mirror. Also a perfect seal must be achieved along the large circumference of the mirror. Furthermore, the reflective coating behind the mirror must be protected from the hot water. These many requirements make the device difficult and expensive to manufacture. If a leak develops while a water-filled mirror is packed in luggage, clothing and other items will get wet.

OBJECTS AND ADVANTAGES

Accordingly, several objects of the invention are to provide a condensation-free mirror which is easy and economical to manufacture, which is highly portable so that it can be conveniently carried, which is reliable and durable, and which is leak-free during storage.

Other objects and advantages of the invention are to provide a condensation-free mirror which can be easily mounted against a shower stall or on the surface of a wall mirror, which can be easily mounted at any height to suit different users, and which provides a convenient way for hanging a shaver.

Further objects and advantages will become apparent from a study of the following description and the accompanying drawings.

DRAWING FIGURES

DRAWING REFERENCE NUMERALS

10. Mirror
11. Housing
11F. Front Frame
11B. Back Plate
12. Filling Cap Assembly
13. Razor Receptacle
14. Suction Cups
15. Bracket
16. Standoff
17. Neck
18. Water Container
19. Cap
20. Reflective Coating
21. Tether
22. Flange
23. Supports
24. Funnel
25F. Front Wall
25B. Back Wall

SUMMARY OF THE INVENTION

A portable condensation-free shower mirror includes a vinyl rubber or urethane water bladder positioned behind an acrylic mirror. The bladder is filled with hot tap water to heat the mirror above the dew point of water to prevent condensation.

Figure 1:
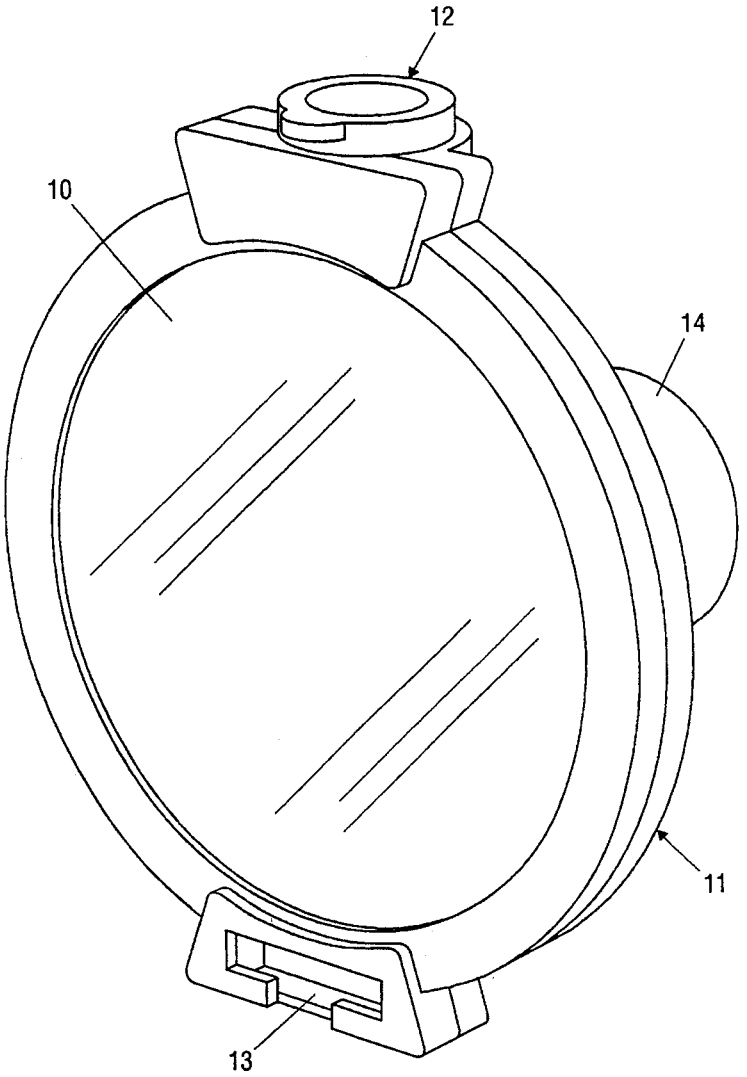
FIG. 1 is a from perspective view of a portable condensation-free shower mirror in accordance with a preferred embodiment of the invention.

Description—FIG. 1—Perspective View of Portable Condensation-Free Mirror

In accordance with a preferred embodiment of the invention as shown in FIG. 1, a portable condensation-free shower mirror includes an acrylic mirror 10 mounted in a plastic housing 11. Acrylic mirror 10 is lightweight and shatterproof. A filling cap assembly 12 is located on the top of housing 11, and a convenient razor receptacle 13 is located on the bottom for receiving the head of a razor (not shown) for temporary storage. Two suction cups 14 (one shown) extend from the back of housing 11 to allow the shower mirror to be easily attached against a shower stall or the face of a conventional wall mirror. The shower mirror can be positioned at any height on a vertical mounting surface to suit different users. In one preferred embodiment, housing 11 was about 15 cm in outside diameter, and the other parts were sized proportionately.

Figure 2:
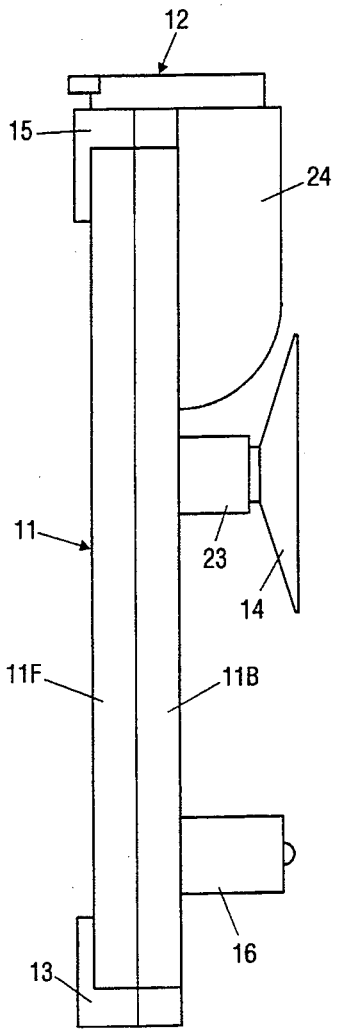
FIG. 2 is a side view of the mirror.

Description—FIG. 2—Side View

As shown in the side view in FIG. 2, housing 11 includes a from frame 11F and a back plate 11B. A small front bracket 15 and a rear funnel 24 surround and support filling cap assembly 12. A standoff 16 extends rearwardly from back plate 11B so that, in conjunction with suction cups 14 (one shown), which are mounted on supports 23 (one shown), the shower mirror will be held parallel to the mounting surface.

Figure 3:
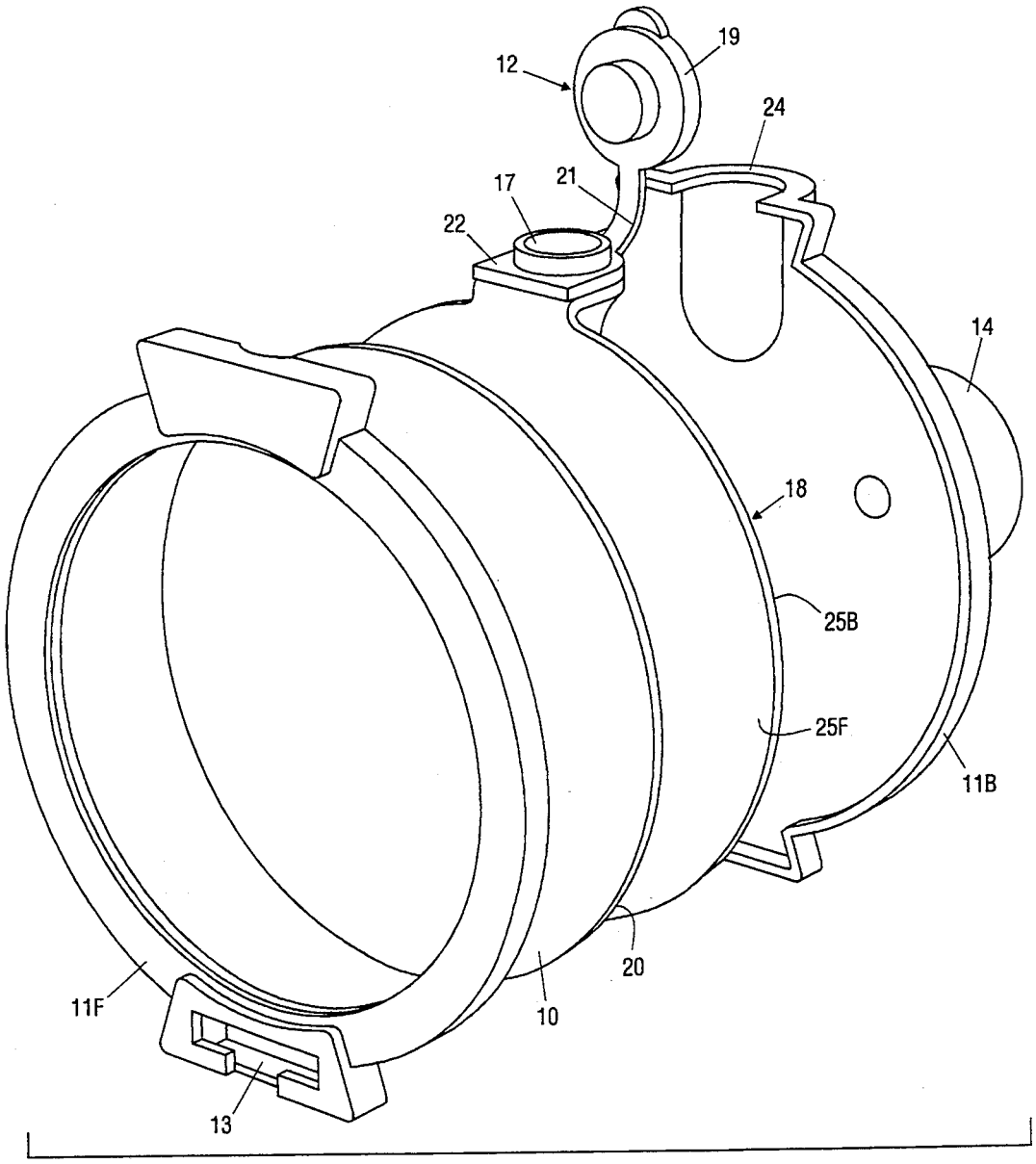
FIG. 3 is an exploded view of the mirror.

Description—FIG. 3—Exploded View

As shown in the exploded view of the shower mirror in FIG. 3, front frame 11F is generally ring-shaped for holding mirror 10 and a vinyl rubber water bladder or container 18 against the generally disk-shaped back plate 11B. Filling-cap assembly 12 includes a neck 17 attached to a cap 19 with an integral tether 21, all of which are molded as a single part from flexible plastic.

Neck 17 includes a flange 22 which is ultrasonically welded to water container 18. This type of construction is commonly found in "hot water bottles." The small circumference of flange 22 makes the welding operation very quick and economical. Funnel 24 allows the upper portion of water container 18 to expand for easier filling. Water container 18 is of substantially the same size and shape as mirror 10, and has front and back walls 25F and 25B, respectively.

When water container 18 and mirror 10 are assembled between front frame 11F and back plate 11B, front wall 25F of container 18 will be in full contact with the entire back side of mirror 10.

OPERATION

To use the mirror, the user fully fills container 18 with hot tap water. The heat will be conducted through container 18 to heat the entire back surface of mirror 10. It will be conducted through to the front surface of mirror 10 to prevent condensation thereon. Water container 18, being relatively thin, will fill very quickly. Cap 19 can be fitted onto neck 17 to provide a water-tight seal. The user then brings the condensation-resistant mirror into the shower or bath, and positions it at a convenient location so that he can shave, or she can apply skin treatments, etc., when the skin is softened by the heat of the shower or bath water. Preferably the user positions the mirror on a wall using suction cups 14, but may position it on a shelf. The water in container 18 will maintain sufficient heat for 15 to 20 minutes to keep mirror 10 clear long enough for most showers or baths.

The shower mirror is highly portable, and can be easily packed into luggage for traveling. It can be easily and quickly setup for use by filling it with hot tap water, then sticking it against a shower stall or wall mirror. It provides a convenient receptacle for hanging a razor. It can be packed away just as quickly by simply drying it; the water can be left in the container if desired, without fear of leaks. It is a great accessory for travelers.

Unlike prior-art mirrors, mirror 10 does not form part of water container 18, so that a water-tight seal is not required between mirror 10 and other components. Because front wall 25F separates the hot water within container 18 from the reflective coating 20 on the back side of mirror 10, coating 20 will not be attacked by the hot water. As a result, the shower mirror is easy and economical to manufacture, and is very reliable and durable.

SUMMARY, RAMIFICATIONS, AND SCOPE

Accordingly the reader will see that I have provided an improved portable condensation-free shower mirror. It is easy and economical to manufacture because mirror 10 is not used to define water container 18. It is compact to carry and easy to setup in any bathroom, shower, or other steamy environment, so that it is very convenient for travelers. It is also reliable and durable.

Although the above descriptions are specific, they should not be considered as limitations on the scope of the invention, but only as examples of the preferred embodiment. Many other ramifications and variations are possible within the teachings of the invention. For example, other types of cap assemblies, such as screw caps, can be used. Instead of suction cups 14, the shower mirror can be provided with a hook or loop for hanging on the shower head's pipe. Razor receptacle 13 can be eliminated without affecting the condensation prevention ability of the mirror. Mirror 10 can be made of glass instead of acrylic. Resilient water container 18 can be made of other materials, such as urethane, or even replaced with a rigid type of container such as a blow-molded, rigid bottle. Container 18 can be permanently or temporarily sealed with water or another fluid therein, and it can be heated by microwaving the entire mirror or removing the container and heating it electrically, or by soaking in a heated solution. Housing 11 can be rectangular, or can be any other shapes, can be made of other materials other than plastic, or even can be eliminated if container 18 is otherwise held against the back of the mirror, e.g., by clamps, a frame, or adhesive. Therefore the reader is requested to determine the scope of the invention by the appended claims and their legal equivalents, and not by the examples given.

We claim:

1. A mirror apparatus, comprising:

a mirror having front and rear surfaces, said front surface being a reflecting surface, and a water container including a front wall and a back wall, said front wall being in substantial contact with said rear surface of said mirror so that said front wall separates contents of said water container from said rear surface of said mirror, said water container comprising a flexible bladder.

2. The mirror apparatus of claim 1 wherein said flexible bladder is made of vinyl rubber.

3. The mirror apparatus of claim 1, further including a housing for receiving said mirror and said water container, said housing including a generally ring-shaped front frame and a generally disk-shaped back plate.

4. The mirror apparatus of claim 3 wherein said housing includes an integral receptacle for receiving and hanging a razor.

5. The mirror apparatus of claim 1, further including attaching means for attaching said mirror apparatus onto a vertical surface.

6. The mirror apparatus of claim 5 wherein said attaching means comprises a suction cup.

7. The mirror apparatus of claim 1, further including a filling-cap assembly attached to said water container for allowing the filling and sealing of said water container.

8. A portable mirror apparatus for use in a bathroom, shower, or other steamy environment, comprising:

a mirror having from and rear surfaces, said front surface being a reflecting surface, a water container including a front wall and a back wall, said front wall being in substantial contact with said rear surface of said mirror so that said front wall separates contents of said water container from said rear surface of said mirror, a filling-cap assembly attached to said water container for allowing the filling and sealing of said water container, and temporary attaching means for releasably attaching said mirror apparatus onto a vertical surface in said bathroom, said water container comprising a flexible bladder.

9. The mirror apparatus of claim 8 wherein said flexible bladder is made of vinyl rubber.

10. The mirror apparatus of claim 8, further including a housing for receiving said mirror and said water container, said housing including a generally ring-shaped front frame and a generally disk-shaped back plate.

11. The mirror apparatus of claim 10 wherein said housing includes an integral receptacle for receiving and hanging a razor.

12. The mirror apparatus of claim 8 wherein said temporary attaching means comprises a suction cup.

13. The mirror apparatus of claim 8 wherein said filling cap assembly comprises a neck attached to said water container, and a cap for fitting over said neck for tightly sealing said water container.

14. A mirror apparatus for use in a bathroom, shower, or other steamy environment, comprising:

a mirror having front and rear surfaces, said front surface being a reflecting surface, a flexible water bladder having front and back walls, said front wall being in substantial contact with said rear surface of said mirror, a neck attached to said water bladder, and a cap for fitting onto said neck for sealing said water bladder so that said front wall separates the contents of said water container from said rear surface of said mirror.

15. The mirror apparatus of claim 14 wherein said flexible water bladder is made of vinyl rubber.

16. The mirror apparatus of claim 14, further including a housing for receiving said mirror and said water bladder, said housing including a generally ring-shaped front frame and a generally disk-shaped back plate.

17. The mirror apparatus of claim 16 wherein said housing includes an integral receptacle for receiving and hanging a razor.

18. The mirror apparatus of claim 14, furthering including a suction cup for attaching said mirror apparatus to a vertical surface.

* * * * *